United States Patent [19]

Patton

[11] Patent Number: 4,565,001

[45] Date of Patent: Jan. 21, 1986

[54] METHOD OF MAKING CRIMP CONNECT TERMINALS

[76] Inventor: Roy A. Patton, 204 W. Howard Ave., Visalia, Calif. 93277

[21] Appl. No.: 612,032

[22] Filed: May 18, 1984

[51] Int. Cl.[4] ..... H01R 43/04

[52] U.S. Cl. ..... 29/866; 339/97 R

[58] Field of Search ..... 29/854, 863, 866, 889; 339/97 R

[56] References Cited

U.S. PATENT DOCUMENTS

| | | | |
|---|---|---|---|
| 3,178,669 | 4/1965 | Roberts | 339/92 M X |
| 3,745,512 | 7/1973 | Johnson et al. | 339/126 R X |
| 3,892,464 | 7/1975 | Griffin | 339/49 R X |
| 4,018,177 | 4/1977 | McKee et al. | 339/97 R X |
| 4,041,604 | 8/1977 | Ackley | 29/854 |
| 4,284,314 | 8/1981 | Lesyk | 339/218 M X |

*Primary Examiner*—Howard N. Goldberg
*Assistant Examiner*—Carl J. Arbes
*Attorney, Agent, or Firm*—George A. Gust

[57] ABSTRACT

Method and apparatus for producing and crimp connecting terminals to insulated wires either with or without prior removal as by stripping of the insulation from the end portion of those wires is disclosed herein. The terminals are particularly suited for use in multiconductor connector assemblies and may be selectively treated to impart enhanced resilience to the connection forming portion of the terminal while maintaining the crimp connecting end thereof more malleable for better crimp electrical connection to the wires.

3 Claims, 13 Drawing Figures

METHOD OF MAKING CRIMP CONNECT TERMINALS

SUMMARY OF THE INVENTION

The present invention relates generally to terminals for connector assemblies and more particularly to terminals of the crimp-on type for use in a multiconductor connector assembly.

In my U.S. Pat. No. 3,497,866 granted Feb. 24, 1970, there is disclosed several variations on multiconductor connector assemblies of the type having a plurality of terminals in each of a plug and receptacle with the terminals having first end portions for slidingly forming connections between respective terminal pairs when the plug and receptacle are mated and second end portions connected to respective wires. In this patented arrangement, connection between the individual lead wires and the corresponding terminals is by conventional soldering techniques. Electrical connectors as disclosed in my prior patent are ideally suited for microelectronics equipment applications however the individual soldering of leads to terminals is a time consuming and costly process, the elimination of which would be highly desirable.

Among the several objects of the present invention, it may be noted the provision of improvements in the process of crimp connecting terminals to lead wires; the provision of improvements in the technique of fabricating terminals for crimp connection to lead wires; the provision of overall improvements in connectors of the type disclosed in my aforesaid mentioned patent; the provision of a crimp connection between a terminal and a lead wire of enhanced mechanical strength, good electrical connection, and not requiring stripping of insulation from the wire prior to the crimping operation; and provision of an elongated terminal for crimp connection to an associated insulated lead wire having enhanced resilience in one region while being more malleable in another region. These as well as other objects and advantageous features of the present invention will be in part apparent and in part pointed out hereinafter.

In general, an improved terminal has near its crimp connection end a pair of laterally opposed wrap tabs for encircling and gripping a wire, a pair of opposed serrated crimping tabs for engaging a conductive portion of the wire establishing electrical connection between the wire and the terminal, and a pair of opposed locking tabs for preventing longitudinal movement of the terminal relative to a connector assembly. One or more staggered pointed projections may be provided in the crimping area for puncturing wire insulation and contacting the conductive portion thereof.

Also in general and in one form of the invention, a plurality of terminals are provided from an elongated strip of terminal stock material and connected to respective insulated lead wires preparatory to disposing the terminals in a multiconductor connector assembly by first blank forming the terminal profiles or silhouettes in the stock material without severing individual terminals from the strip and thereafter shaping the crimp connection end portions of those terminals to a "U" configuration to receive lead wires whereupon the respective lead wires are crimp connected to the terminals and then the interconnected terminals and wires are separated from the strip and remaining terminals. Selective heat treating of the strip to provide enhanced resilience to one terminal end while maintaining the other terminal end more malleable for crimp connecting purposes may be employed.

BRIEF DESCRIPTION OF THE DRAWINGS

Corresponding reference characters indicate corresponding parts thereout the several views of the drawing.

Figure 1:
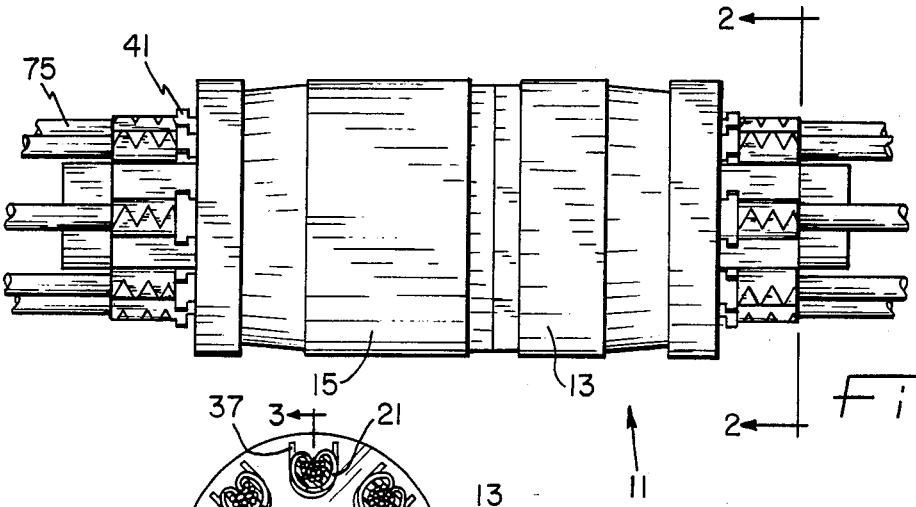
FIG. 1 is a side elevation view of a multiconductor connector assembly embodying the present invention.
Figure 2:
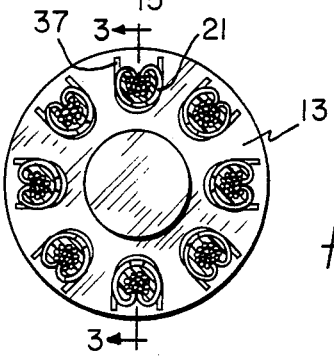
FIG. 2 is a right end view in cross-section along line 2—2 of the connector assembly of FIG. 1.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring first primarily to FIGS. 1 through 4 there is illustrated a multiconductor connector assembly of the type generally illustrated in my aforementioned U.S. Pat. No. 3,497,866 and differing from my patented device only as hereinafter noted. Hence, reference may be had to my prior patent for details not herein recited. Briefly, such a multiconductor connector assembly 11 comprises a mateable plug 13 and receptacle 15 of molded insulating material and each supporting a plurality terminals with eight (8) such terminals illustrated in each of the plug and receptacle of FIGS. 1 through 4 while connectors of eight (8) and of twenty (20) pins or terminals are illustrated in my aforementioned patent.

Plug protrusion 17 mates with a receptacle cavity 19 with both the protrusion and cavity being generally cylindrical but with each including a flattened face to ensure proper alignment of the plug and receptacle. When the plug and receptacle are mated, the respective terminals slidingly engage one another to form the individual connections as best seen in FIG. 3.

Figure 3:
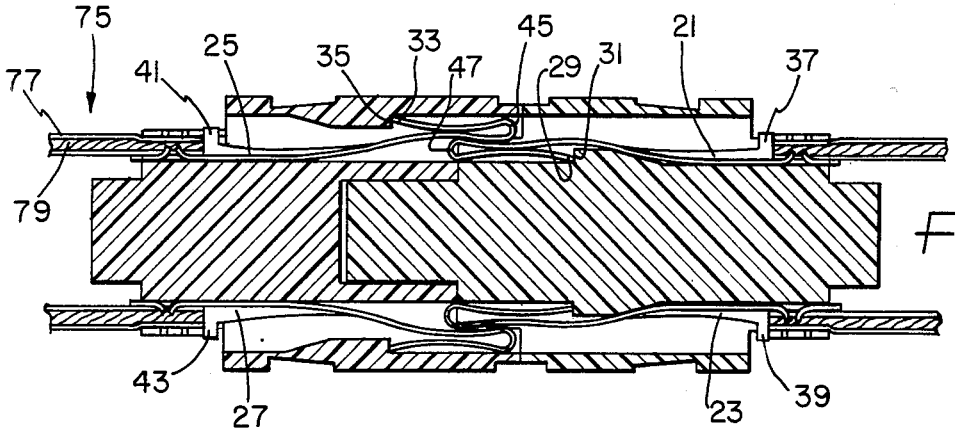
FIG. 3 is a view in cross section along the lines 3—3 of FIG. 2.
Figure 4:
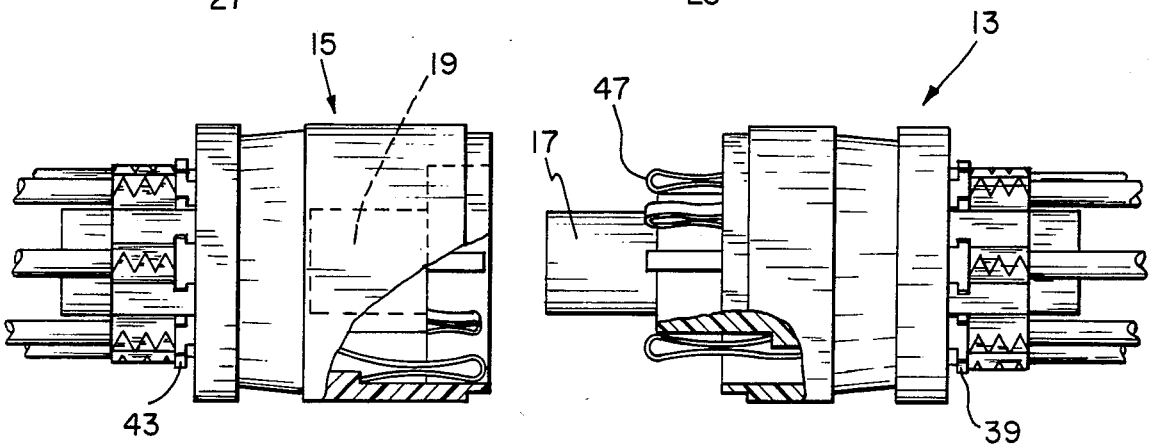
FIG. 4 is a view similar to FIG. 3 but illustrating the plug and receptacle of the connector assembly separated from one another.

In FIG. 3, the terminals such as 21 and 23 associated with plug 13 are all substantially alike and differ only slightly from the terminals such as 25 and 26 associated with receptacle 15. Terminals such as 21 and 23 may be referred to as male terminals while terminals such as 25 and 27 are referred to as female terminals. The primary difference between these two types of terminals is that the free end such as 29 of terminal 21 engages a ledge 31 within the plug 13 which ledge is radially inwardly of the terminal location whereas terminal 25 has a free end 33 which engages a ledge 35 radially outwardly of the terminal in the socket 15. Either type may be formed from the same blank configuration by different forming of the blank. The terminals typically have the lead wires attached thereto and are then positioned in the plug and receptacle by sliding the terminals from the outer ends of plug and receptacle until the free ends such as 29 or 33 snap into position against the ledges such as 31 and 35. The engagement of these free ends and ledges prevents the terminals from being pulled outwardly from the connector assembly while further axial movement in the opposite direction is prevented by tabs such as 37, 39, 41 and 43 to be described in greater detail subsequently. In my prior patented arrangement, the tabs such as 37, 39, 41 and 43 were not present, however, their general function of limiting axial movement of the terminals was provided by a generally "U" shaped trough which also formed the region for soldering connection between the terminals and the respective lead wires. As noted earlier, this soldering interconnection between the lead wires and terminals which could be performed after assembly of the terminals into the plug and socket, but preferably was performed prior to such assembly is a costly and time consuming operation which is eliminated by the present invention.

Figure 7:
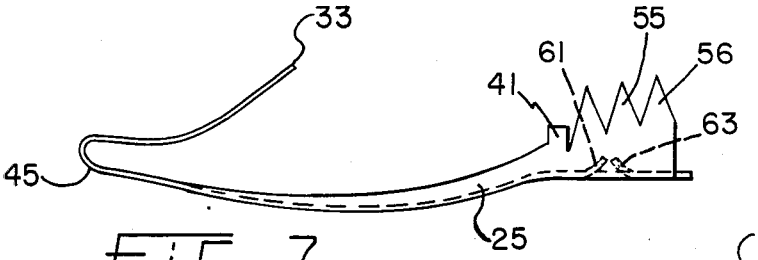
FIG. 7 is a side elevation view of the crimp terminal of FIG. 6 formed preparatory to receiving a lead wire and placement in a plug.
Figure 9:
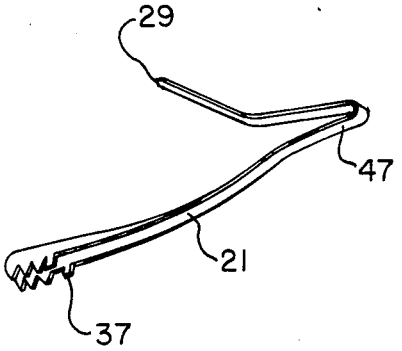
FIG. 9 is a perspective view of a terminal similar to FIG. 7 but designed to be disposed in the socket of FIGS. 1 through 4.

Comparing FIGS. 3, 7 and 9, it will be noted that the male terminal illustrated in FIG. 9 and the female terminal illustrated in FIG. 7 differ from one another primarily in the direction in which the sliding connection forming end portions 45 and 47 are bent with those terminals being otherwise similar and hence forth only an exemplary female terminal 25 and its technique of fabrication will be described.

Figure 5:
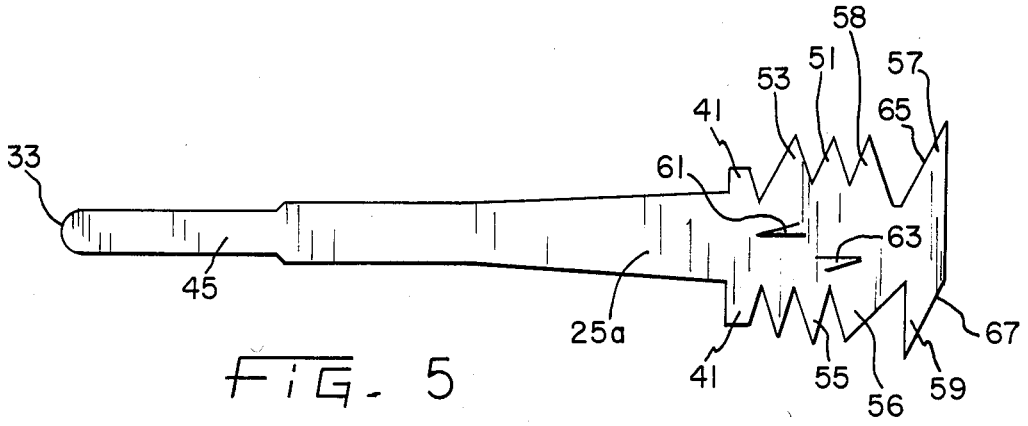
FIG. 5 is a plan view of an unformed crimp terminal according to the present invention.
Figure 6:
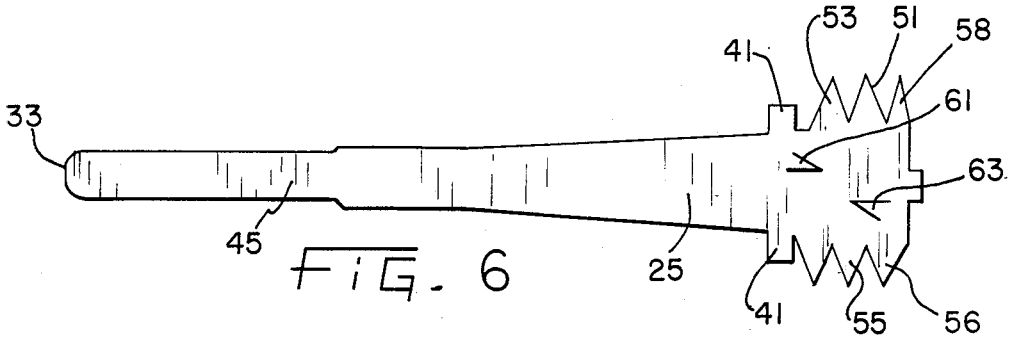
FIG. 6 is a plan view similar to FIG. 5 but illustrating one modification of the crimp terminal.

Referring now to FIG. 6, exemplary terminal 25 is blanked as by a punching or shearing operation from an elongated strip of terminal stock material 49 (FIG. 10) so as to have near its second or wire lead connection end portion the pair of laterally opposed locking tabs 41 which prevent longitudinal movement of the terminal relative to the connector assembly as well as a pair of opposed serrated crimping tabs including projections such as 51, 53, 55, 56 and 58 with these serrated crimping tabs intended for establishing electrical connection between the wire and terminal by engaging a conductive portion of the wire. Optionally, a pair of laterally opposed wrap tabs 57 and 59 for encircling and gripping an associated wire may also be formed near the second end as illustrated in FIG. 5. A pair of staggered pointed projections 61 and 63 for puncturing wire insulation and contacting the conductive portion of a wire may also be formed in the second end during the blank forming of the terminal silhouette or profile. It will be noted that the opposed serrations as illustrated by the projections such as 51, 53 and 55 are relatively staggered. This allows some interleaving of the crimping tab as it is formed about a wire. It will also be noted that the blank forming of terminal 25*a* of FIG. 5 includes shearing material from laterally opposed edges 65 and 67 of the wrap tabs at an oblique angle to the general direction of elongation of terminal 25*a* with those two laterally outermost edges 65 and 67 extending generally parallel to one another so that, when the wrap tab is crimped about an insulated portion of a lead wire, those two edges are juxtaposed by the crimping operation. This oblique outermost edge allows some latitude in the range of wire sizes to be gripped. Other than the presence of the wrap tabs 57 and 59, the terminals 25 of FIG. 6 and 25*a* of FIG. 5 are identical and like reference numerals are used throughout those two drawing views.

Figure 8:
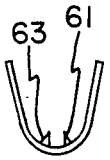
FIG. 8 is an end view of the terminal of FIG. 7.
Figure 10:
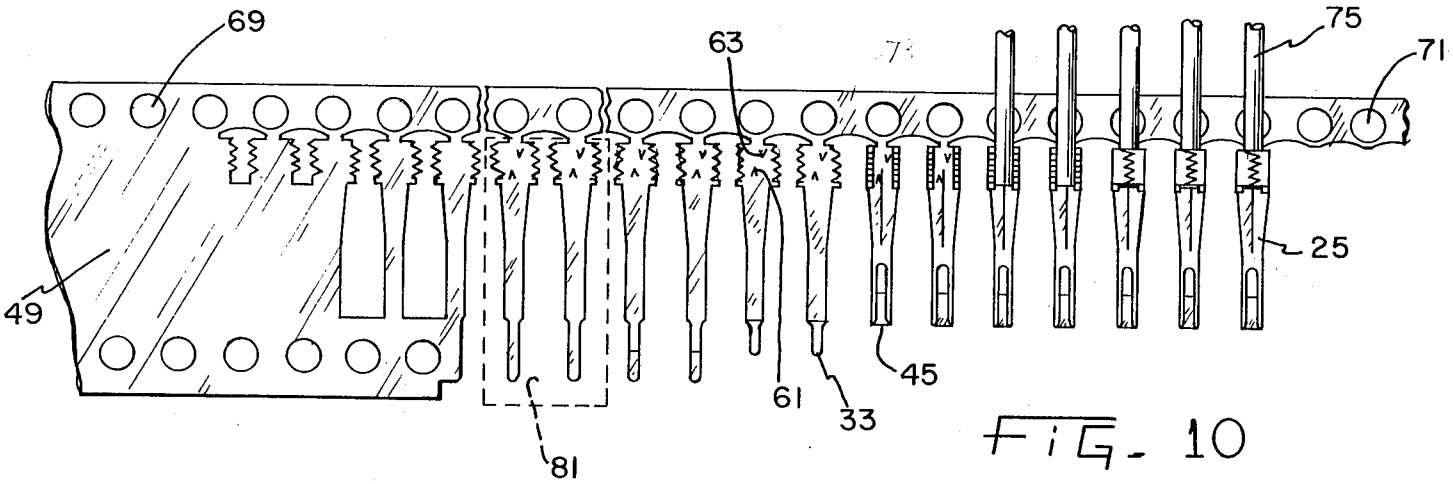
FIG. 10 illustrates the sequential blank forming of the terminal silhouettes beginning with a strip of terminal stock material and ending with a formed terminal and lead wire crimped thereto but still connected to the strip of material.

Referring now primarily to FIG. 10, an elongated strip 49 of, for example, beryllium copper contact material of about 0.005 inch thickness having strip feed holes such as 69 and 71 is passed through a sequence of blanking or shearing, and forming dies to first generate the terminal silhouettes or profiles as illustrated in FIGS. 5 and 6 and to thereafter provide the required bends for the first or contacting making ends such as 45 and the general "U" shape configuration as illustrated in FIG. 8 to the crimping end of the terminal for subsequently receiving a lead wire. Desirably, the entire process illustrated in FIG. 10 may be accomplished while not severing the individual terminals from the strip so that the strip edge 73 remains attached to each of the individual terminals until lead wires such as 75 are crimped to the individual terminals and thereafter a simple bending motion between the strip edge 73 and the individual terminal frees that terminal from edge 73. In the blank forming operation, the individual terminals are formed with their respective directions of elongation transverse to the elongation of the strip and the perforation forming projections 61 and 63 are formed early in the process and preferably prior to shaping the terminal crimp end to the configuration illustrated in FIG. 8.

Figure 13:
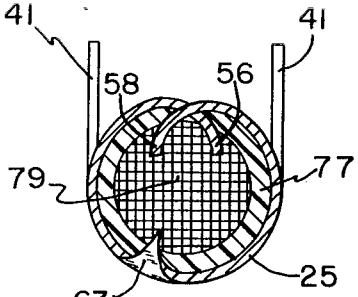
FIG. 13 is a view in cross-section along lines 13—13 of FIG. 12.
Figure 12:
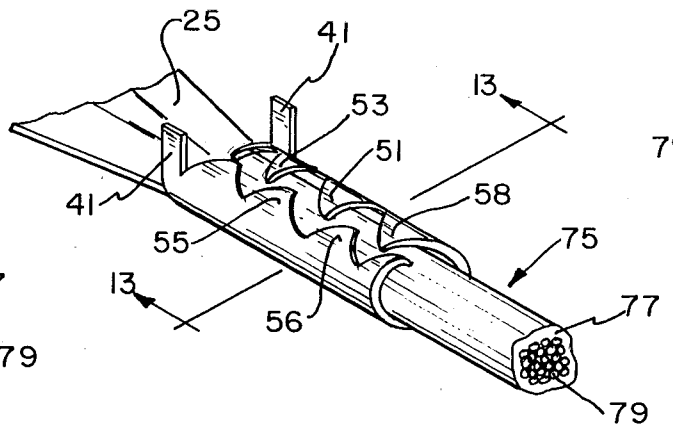
FIGS. 11 and 12 illustrate the sequential forming of the terminal end about an insulated lead wire.
Figure 11:
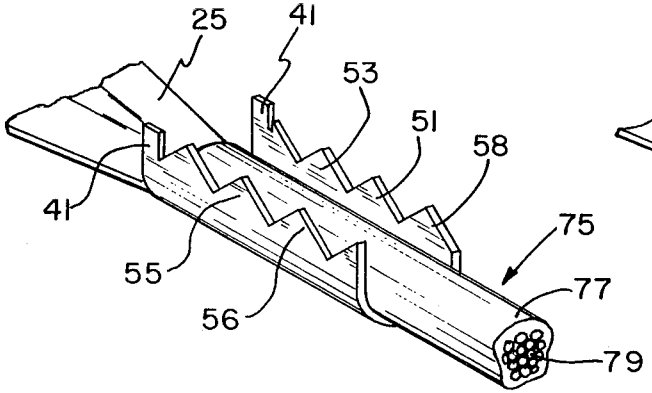

The crimping attachment of a terminal to a lead wire is best seen in FIGS. 11–13. The crimping may be of the "D" type of the "B" type for either the wrap tab or the crimp tab but of course the locking tabs 41 are not crimped but rather remain in the position illustrated in FIG. 11 to prevent longitudinal movement of the terminal in the connector assembly. Crimping may be to either insulated wire which has not had the insulation stripped therefrom for the connection in which case the projections 61 and 63 punch through that insulation making good contact with the conductors in the wire and additionally and in particular if a "B" type crimp is employed the serrated edges and their projections 51, 53 and 55 also pierce through the insulation jacket 77 and into a conductor within the wire, or crimping may be to a previously stripped wire end. The same terminal is suitable for either type crimping operation. The conductor itself may, of course, be of the stranded, wrapped or solid variety as desired with a stranded conductor 79 being illustrated.

To achieve a good crimp connection to lead wire 75 it is desirable that the deformation of the terminal end being crimped to the wire be substantially plastic in nature with little or no resilience to the serrated crimping tabs or, if present, the locking tabs 57 and 59. Such resilience would be deleterious to the crimp connection manifesting itself as some withdrawal or loosening of the crimp tab from about the wire. On the other hand, the remaining portion of the terminal should possess some resilience since some terminal deformation occurs each time the plug and socket are mated or separated. Selective treatment of the terminals by a precipitation hardening technique may be employed to impart a resilience to the terminal first end portions which cooperate during mating and unpluging of the connector while maintaining the second end portions, that is those portions involved in the crimp connecting process, more malleable or ductile. One technique for accomplishing this selective treatment of the terminals is to merge the blank formed strip of terminal silhouettes which are still connected to the edge strip 73 with a strip of metallic foil 81 as illustrated in FIG. 10. The foil strip 81 is of a width sufficient to cover the blank formed terminals while leaving the edge 73 exposed. The two merged strips may be wound together on a spindle and then heated in an oxidation preventing atmosphere and subsequently cooled with the foil acting as a heat sink imparting a differential heat treating effect to the two ends of the terminals.

From the foregoing it is now apparent that a novel terminal for a multiconductor connector assembly as well as a novel approach to both the fabrication and crimp connecting of the terminal to a lead wire have been disclosed meeting the objects and advantageous features set out herein before as well as others and that modifications as to the precise configurations, shapes and details may be made by those having ordinary skill in the art without departing from the spirit of the invention or the scope thereof as set out by the claims which follow.

What is claimed is:

1. The method of providing a plurality of terminals from an elongated strip of terminal stock material and connecting those terminals to respective insulated lead wires preparatory to disposing the terminals in a multiconductor connector assembly comprising the steps of:

blank forming terminal silhouettes in the stock material without severing individual terminals from the strip, the blank formed terminal silhouettes being elongated in a direction transverse to the elongation of the strip, and having first free end portions for selective sliding connection with other terminals in the connector assembly and second interconnected end portions for crimping connection to respective lead wires;

shaping the second end portions into a "U" configuration to receive lead wires;

crimp connecting respective lead wires and corresponding terminals;

separating crimp connected terminals one from another, and disposing the crimp connected terminals and corresponding lead wires in connector assemblies, perforating the terminal second end portions prior to the step of shaping to form pointed projections for piercing wire insulation and making electrical connection with lead wires during the step of crimp connecting.

2. The method of providing a plurality of terminals from an elongated strip of terminal stock material and connecting those terminals to respective insulated lead wires preparatory to disposing the terminals in a multiconductor connector assembly comprising the steps of:

blank forming terminal silhouettes in the stock material without severing individual terminals from the strip, the blank formed terminal silhouettes being elongated in a direction transverse to the elongation of the strip, and having first free end portions for selective sliding connection with other terminals in the connector assembly and second interconnected end portions for crimping connection to respective lead wires;

shaping the second end portions into a "U" configuration to receive lead wires;

crimp connecting respective lead wires and corresponding terminals;

separating crimp connected terminals one from another; and disposing the crimp connected terminals and corresponding lead wires in connector assemblies, selectively precipitation hardening the terminal first end portions to enhance the resilience thereof while maintaining the second end portions more malleable.

3. The method of claim 2 wherein the hardening step includes merging the blank formed strip of terminal silhouettes with a strip of metalic foil of a width to cover the blank formed terminals while leaving an edge of stock material adjacent the second interconnected end portions exposed, heating the merged strips in an oxidation preventing atmosphere, and subsequently cooling the merged strips.

* * * * *